US009500064B2

(12) United States Patent
Hofman et al.

(10) Patent No.: US 9,500,064 B2
(45) Date of Patent: Nov. 22, 2016

(54) FLOW BYPASS DEVICE AND METHOD

(71) Applicant: Peak Completion Technologies, Inc., Midland, TX (US)

(72) Inventors: Raymond Hofman, Midland, TX (US); William Sloane Muscroft, Midland, TX (US); Bryan Fitzhugh, Midland, TX (US)

(73) Assignee: Peak Completion Technologies, Midland, TX (US)

( * ) Notice: Subject to any disclaimer, the term of this patent is extended or adjusted under 35 U.S.C. 154(b) by 183 days.

(21) Appl. No.: 14/301,020

(22) Filed: Jun. 10, 2014

(65) Prior Publication Data

US 2015/0068752 A1 Mar. 12, 2015

Related U.S. Application Data

(63) Continuation-in-part of application No. 13/423,154, filed on Mar. 16, 2012, now Pat. No. 9,121,248, and a continuation of application No. 13/694,509, filed on Dec. 7, 2012, now abandoned.

(60) Provisional application No. 61/453,281, filed on Mar. 16, 2011.

(51) Int. Cl.

| | |
|---|---|
| ***E21B 33/12*** | (2006.01) |
| ***E21B 34/14*** | (2006.01) |
| ***E21B 43/26*** | (2006.01) |
| *E21B 34/00* | (2006.01) |
| *E21B 43/14* | (2006.01) |

(52) U.S. Cl.

CPC ..... *E21B 34/14* (2013.01); *E21B 43/26* (2013.01); *E21B 43/14* (2013.01); *E21B 2034/007* (2013.01)

(58) Field of Classification Search

CPC .... E21B 34/14; E21B 21/103; E21B 34/103; E21B 2034/007; E21B 21/10; E21B 34/06

See application file for complete search history.

(56) References Cited

U.S. PATENT DOCUMENTS

| | | | | |
|---|---|---|---|---|
| 5,048,611 | A * | 9/1991 | Cochran | E21B 21/103 166/319 |
| 5,873,414 | A * | 2/1999 | von Gynz-Rekowski | E21B 21/103 166/141 |
| 6,065,541 | A * | 5/2000 | Allen | E21B 23/04 166/222 |
| 6,189,618 | B1 * | 2/2001 | Beeman | E21B 34/14 166/194 |
| 6,253,861 | B1 * | 7/2001 | Carmichael | E21B 21/103 175/237 |
| 7,021,389 | B2 * | 4/2006 | Bishop | E21B 34/14 166/317 |
| 7,628,213 | B2 * | 12/2009 | Telfer | E21B 21/103 166/222 |
| 7,954,555 | B2 * | 6/2011 | Ashy | E21B 21/103 166/318 |
| 8,291,988 | B2 * | 10/2012 | King | E21B 23/04 166/153 |
| 8,550,176 | B2 * | 10/2013 | Knobloch, Jr. | E21B 21/103 166/334.1 |
| 8,646,531 | B2 * | 2/2014 | King | E21B 34/14 166/318 |
| 8,662,162 | B2 * | 3/2014 | Kellner | E21B 34/14 166/192 |

(Continued)

*Primary Examiner* — Daniel P Stephenson

(57) ABSTRACT

Devices, systems and methods are disclosed for re-directing fluid flow from the interior of tubing placed in a well to the exterior of the tubing by use of selectively actuatable valves operable by engagement of a plug on a plug seat. The devices, systems, and methods disclosed may provide a flowback bypass for the flow of fluids around obstructions in the tubing when those obstructions occur at a predicted location within the tubing. The systems, devices and methods may also include a locking system operable by, among other things, plug and plug seat valves, and such locking system may be used to prevent opening of the flowback bypass until after a predetermined event has occurred.

19 Claims, 9 Drawing Sheets

(56) References Cited

U.S. PATENT DOCUMENTS

| | | | | |
|---|---|---|---|---|
| 8,662,178 | B2 * | 3/2014 | Norrid | E21B 34/102 166/305.1 |
| 2009/0056952 | A1 * | 3/2009 | Churchill | E21B 21/10 166/373 |
| 2011/0030947 | A1 * | 2/2011 | Schreiber | E21B 33/138 166/250.01 |
| 2013/0014953 | A1 * | 1/2013 | van Petegem | E21B 34/14 166/308.2 |
| 2013/0168099 | A1 * | 7/2013 | Themig | E21B 34/103 166/308.1 |
| 2014/0041876 | A1 * | 2/2014 | Fleckenstein | E21B 34/08 166/306 |
| 2014/0158368 | A1 * | 6/2014 | Hofman | E21B 34/14 166/373 |
| 2015/0068752 | A1 * | 3/2015 | Hofman | E21B 43/26 166/308.1 |
| 2015/0184489 | A1 * | 7/2015 | Resweber | E21B 33/146 166/289 |

* cited by examiner

FLOW BYPASS DEVICE AND METHOD

CROSS REFERENCE TO RELATED APPLICATIONS

This application is a continuation-in-part of U.S. patent application Ser. No. 13/423,154 filed on Mar. 16, 2012 and entitled "Downhole System Incorporating Valve Assembly with Resilient Deformable Engaging Element", which claims the benefit of U.S. Provisional Application Ser. No. 61/453,281 filed Mar. 16, 2011 and entitled "Multistage Production System Incorporating Downhole Tool with Deformable Ball" and a Continuation of U.S. patent application Ser. No. 13/694,509 filed on Dec. 12, 2012; all of which are incorporated by reference herein.

FIELD OF DISCLOSURE

This disclosure provides methods, systems and devices for re-directing flow through tubing in a well, inside other tubing, or other enclosed space.

BACKGROUND

Tools incorporating valve assemblies having a plug, such as a ball or dart, and a plug seat, such as a ball seat or dart seat, have been used for a number of different operations in wells for oil gas and other hydrocarbons. These tools may be incorporated into a string of pipe or other tubular goods inserted into the well. The valve assemblies provide a defined location at which the flow of fluid past may be obstructed and, with the application of a desired pressure, a well operator can actuate one or more tools associated with the assembly.

Remotely operated valve assemblies may be used in the treatment of a subterranean formation adjacent to a well. Valves used for this purpose open ports in the tubing to facilitate treatment of a selected area or section of the formation. The treatments are performed by pumping fluid through the wellhead, into the tubing string and out of the selectively opened ports. Examples of such well treatments include acidizing or fracing. Acidizing cleans away acid soluble material near the well bore to open or enlarge the flow path for hydrocarbons into the well. Fracing may occur by injecting fluids from the surface through the wellbore and into the formation at high pressure to create and force fractures to open wider and extend further. The injected frac fluids may contain a granular material, such as sand, which holds fractures open after the fluid pressure is reduced. Such granular materials are not necessarily required, however. While acidizing and fracing are two examples of treatments that may be performed through the valve assemblies, the scope of the present disclosure is not limited to any particular formation treatment(s) and may include any other treatment, such as, without limitation, CO2 injection, treatment with scale inhibitors, iron control agents, corrosion inhibitors or others.

Treatments in multiple-stage production wells may require selective actuation of downhole tools, such as sleeve assemblies, to control fluid flow from the tubing string to the formation. For example, U.S. Pat. No. 7,926,571 entitled Cemented Open Hole Selective Fracing System, which is incorporated by this reference, describes a system using multiple valve assemblies having ball-and-seat seals, each having a differently sized ball seat and corresponding ball. Such ball-and-seat arrangements are operated by placing an appropriately sized ball into the well bore and bringing the ball into contact with a corresponding ball seat. The ball engages on a section of the ball seat to block the flow of fluids past the valve assembly. Application of pressure to the valve assembly, such as through use of fluid pumps at the surface, may create a pressure differential across the valve assembly, causing the valve assembly to "shift" and thereby open fluid flow the sleeve to the surrounding the formation. Other types of plugs such as darts, or any other shape that can be used to selectively operate the valve assemblies, may also be used to seal the seat and facilitate the creation of a pressure differential to shift the valve assembly and open the sleeve, or actuate a different tool, such as a plug and seat actuated flapper valve, associated with the valve assembly.

If the well or tubing contains multiple plug seats, methods, systems or apparatuses must be employed for passing a plug through certain plug seats, including passing through at least some plug seats without actuating any devices associated with such seats. One such method is to use a ball, dart or other plug that is small enough so that it will not seal against any of the seats it encounters prior to reaching the desired seat. For this reason, the smallest ball to be used for the planned operation is the first ball placed into the well or tubing and the smallest ball seat is positioned in the well or tubing the furthest from the wellhead. After the desired treatments are completed, the direction of fluid flow is reversed so that the treating fluids and formation fluids may be produced through the wellhead. Because each plug is smaller than the seats past which it traveled, the plugs simply move with the fluids through the previously passed plug seats and out of the well.

Valve assemblies, which rely solely on the size of the plug and the seat opening for selecting the tool to actuate, significantly limit the number of valves that can be used in a given tubing string. In such systems each ball size is only able to actuate a single valve and, generally, each plug must have a diameter of at least 0.125 inches larger than the immediately preceding plug. Thus, the size of the liner restricts the number of valve assemblies with differently-sized ball seats.

Devices and assemblies have been introduced to increase the number of valve assemblies that may be actuated by a single plug, such as a ball, dart, or other plug. Such devices and assemblies include those described in U.S. application Ser. No. 12/702,169, filed Feb. 28, 2010 and entitled "Downhole Tool With Expandable Seat;" U.S. application Ser. No. 13/423,154, filed Mar. 16, 2012 and entitled "Downhole System and Apparatus Incorporating Valve Assembly With Resilient Deformable Engaging Element;" and U.S. application Ser. No. 13/423,158, filed Mar. 16, 2012 and entitled "Multistage Production System Incorporating Downhole Tool With Collapsible or Expandable C-Ring," each of which is incorporated herein by reference. The devices, methods, and assemblies described in these applications, however, place one or more plugs downstream of plug seats with openings smaller than the diameter or other cross sectional dimension of the plug. When the fluid flow is reversed, i.e., fluid begins flowing toward the wellhead, such plugs may seat on the back or outlet side of a previously passed plug seat, blocking the reverse flow. The methods for removing such blockages, such as drilling out the tubing string, are both time consuming and expensive. Therefore, there exists a need for cost effective and time efficient devices and/or methods for circumventing such blockages and thereby allowing the flow of fluids from the well bore to the surface.

BRIEF SUMMARY OF CERTAIN EMBODIMENTS

The present disclosure describes systems, methods, and apparatuses for allowing fluid flow to bypass such a blockage. Further, the bypass of such present disclosure is not limited to blockages caused by plugs traveling upstream. Rather, the bypass may operate in response to any event or events that limit flow and/or create a pressure differential at a pre-identified point in the tubing string.

In some embodiments of the present disclosure, it is desirable that the flow bypass remain closed until a predetermined triggering event has occurred. Such triggering events include, without limitation, shifting of a valve assembly in response to a pressure differential across that valve assembly. Therefore, the present disclosure further encompasses valve assemblies including a sequencing mechanism which prevents fluid from flowing through the bypass assembly until after the pre-determined triggering event has occurred. The sequencing mechanism may be a locking assembly configured for use in a tubing string to prevent actuation of one or more tools until after the lock is released. Further, the locking mechanism may be used in connection with the flowback bypass of the present disclosure, though the locking mechanism of the present disclosure is in no way limited to use with the flowback bypass or any other specific tool, method, or assembly.

Embodiments of this disclosure generally provide devices, methods and systems for use in a tubing string. An apparatus of the present disclosure may comprise a housing, with an interior passage for the flow of fluids, an obstruction in the interior passage, and a flow bypass around the obstruction. The obstruction is preferably a plug seat, but may be any feature of the tubing or apparatus that may obstruct, or cooperate with fluids or solids in the tubing to obstruct, fluid flow towards the wellhead. In other words, the obstruction may not prevent fluid flow by itself, but instead define a location at which fluid flow may be blocked during operations performed using, in, or on the tubing string. The flow bypass may be blocked by a barrier, and the barrier may be held in place, either wholly or partially, by a locking mechanism. In certain embodiments, such locking mechanism is released in response to a particular event, such as a predetermined pressure differential created across the plug seat, preferably with the higher pressure occurring on the wellhead side of the plug seat. The bypass is then allowed to open in response to a pressure differential across the plug seat in the opposite direction.

A method of the present disclosure may include engaging a first plug on an uphole side of a first plug seat in a first sleeve assembly and opening, at least partially, a first set of ports located on the first sleeve assembly. Further, a second plug may be engaged on a downhole side of the first plug seat, and opening, at least partially, a second set of ports on the first sleeve assembly, wherein at least part of a fluid flow passes through the second set of ports to exit the first sleeve assembly, bypasses the first plug seat and re-enters the first sleeve assembly at the first set of ports.

In another embodiment, a system includes a first plug engaging an uphole side of a first plug seat in a first sleeve assembly. Further, the system includes a first set of ports at least partially opened on the first sleeve assembly. Further still, the system includes a change, subsequent to the first set of ports being opened, of a fluid flow to upstream in the tubing string. Yet further, the system includes a second plug engaging a downhole side of the first plug seat, and a second set of ports at least partially opened on the first sleeve assembly, wherein the fluid flow bypasses the first plug seat.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF EXAMPLE EMBODIMENTS

The following is a detailed description of example embodiments of the invention depicted in the accompanying drawings. The amount of detail offered is not intended to limit the anticipated variations of embodiments; on the contrary, the intention is to cover all modifications, equivalents, and alternatives falling within the spirit and scope of the present disclosure as defined by the appended claims. The detailed descriptions below are designed to make such embodiments obvious to a person of ordinary skill in the art.

Generally speaking, methods and systems for use in a tubing string are contemplated. The methods and systems permit mechanical control of fluid flow from a wellhead to a formation through use of at least two plugs, such as plugs, balls or darts, wherein the plugs are optionally dissimilar. Further, the methods and systems provide for a flow bypass around a plug that may be trapped in the tubing string. The fluid, of course, may comprise treating fluids, hydrocarbons, water, impurities or other mined substances, for example, which may be carried to the wellhead through use of solutions under pressure. The substances comprising the fluid may or may not be completely or partially dissolved, and may exist in one or more physical states of gas, liquid, or solid.

Figure 1:
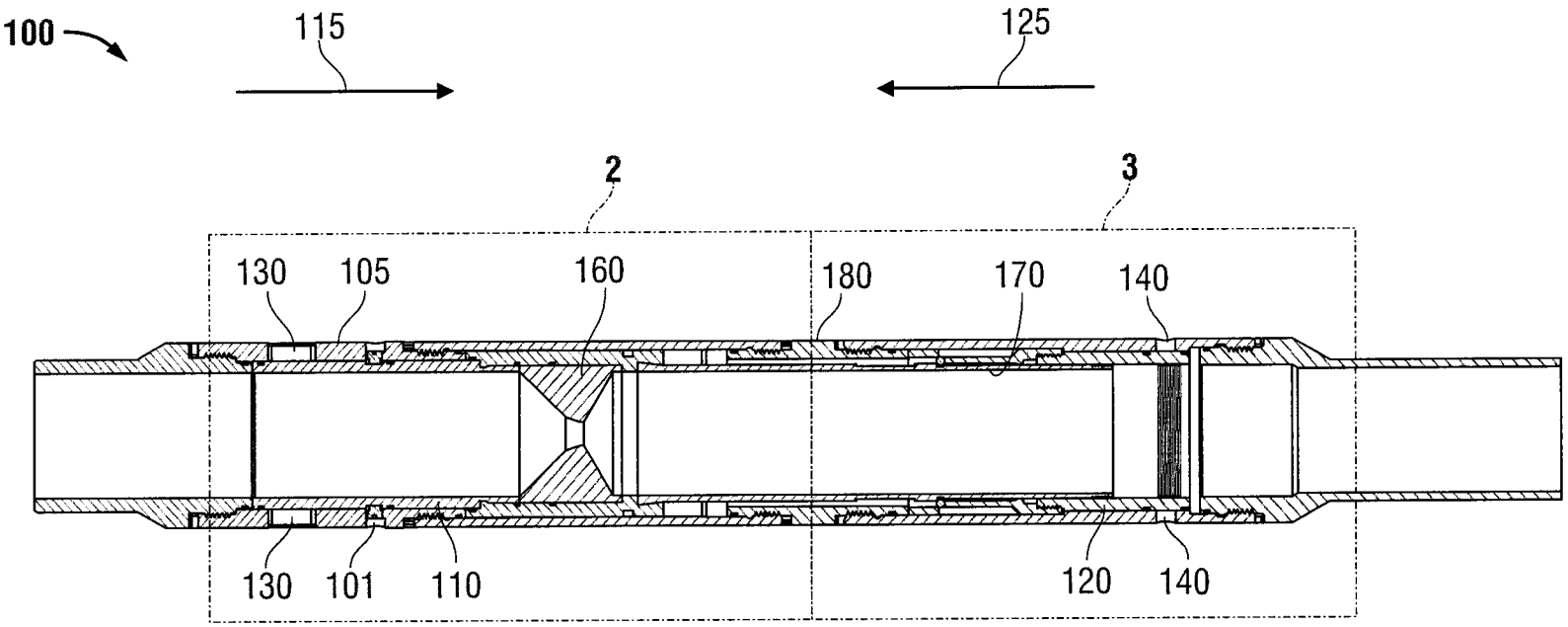
FIG. 1 depicts a cross sectional view of an example embodiment of a first sleeve assembly that may be found in a tubing string, such as in a well for oil, gas, or other hydrocarbons.

Turning to the drawings, FIG. 1 depicts a sleeve assembly 100 having two sleeves, namely a first sleeve 110 and a second sleeve 120. The sleeves 110, 120 lie within a housing 105 with upper housing ports 130 and lower housing ports 140, such that shifting the first sleeve 110 along the longitudinal axis of the tubing string will open the upper housing ports 130 and shifting the second sleeve 120 along the longitudinal axis of the tubing string will open the lower housing ports 140. In the illustrated embodiment, the housing ports 130, 140 are opened by shifting the first sleeve 110 or second sleeve 120, respectively, completely off of the effected housing ports 130, 140. Such depiction is illustrative and not limiting; any method for opening the upper housing ports 130 and lower housing ports 140, such as shifting a sleeve to align sleeve ports with the housing ports, is within the scope of the present disclosure. The sleeve assembly 100 has a plug seat 160, that may engage an appropriate plug such as a ball, dart, plug, or other blocking and/or sealing device. Further, the shape of the plug seat 160 may vary in some embodiments from the shapes illustrated in this disclosure provided that a plug seat 160 may accomplish the system and methods disclosed herein.

In the illustrated embodiment, the housing 105 comprises multiple sections, including a crossover section 180. The various sections of the housing of the illustrated embodiment are present for purposes of assembling the tool and are not required as part of the present disclosure. Thus, the housing of the illustrated embodiments may be of one piece of or a plurality pieces.

Figure 2:
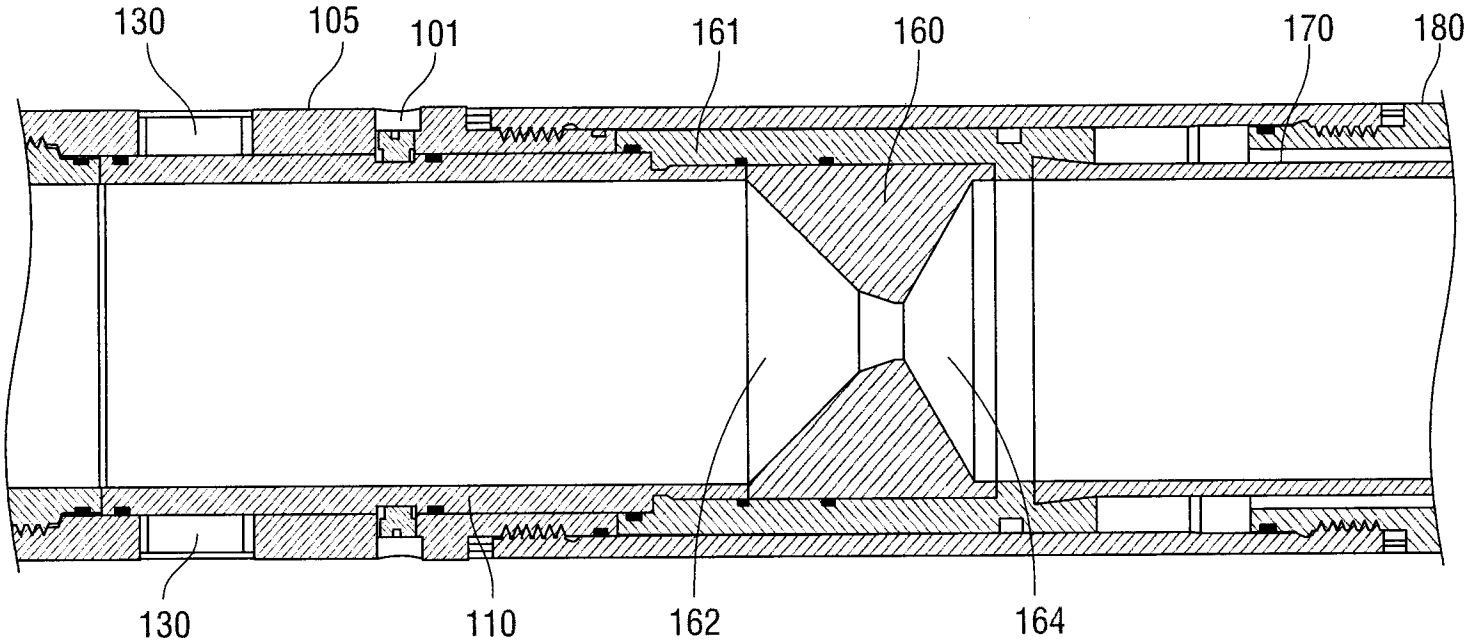
FIG. 2 depicts an enlarged portion of the example embodiment from FIG. 1.
Figure 3:
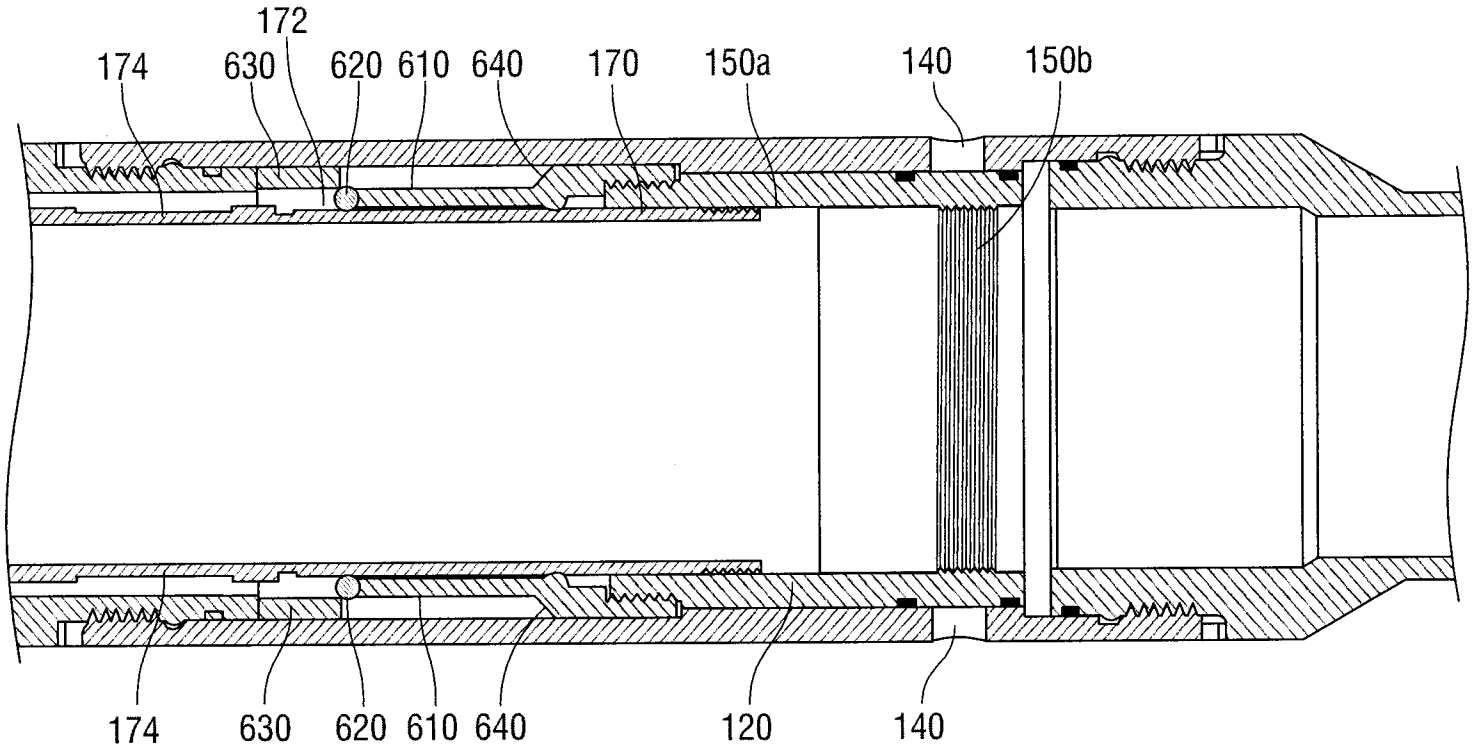
FIG. 3 depicts another enlarged portion of the example embodiment from FIG. 1.

The embodiment of FIG. 1 is further depicted in FIGS. 2 and 3. FIG. 2 generally depicts the embodiment device on one side of the crossover 180, while FIG. 3 generally shows the embodiment of FIG. 1 on the other side from crossover 180.

Turning to FIG. 2, shear pins 101 engage housing 105 and the first sleeve 110 to control movement of the first sleeve. Further, the plug seat 160, first sleeve 110 and locking sleeve 170 and, if present, plug seat carrier 161 are interconnected such that they move as unit inside the housing. Thus, when a pressure differential is created across the plug seat 160, the force of the pressure differential is transferred to the shear pins 101 via the first sleeve 110 and the shear pins 101 can be, and typically are, configured to break when the pressure differential across the plug seat 160 exceeds a desired pressure. In other words, the shear pins 101 prevent the first sleeve 110, plug seat 160, and locking sleeve 170 from shifting until a desired pressure differential is created across the plug seat 160. While the shear pins 101 are illustrated to connect the first sleeve 110 with the housing 105, the shear pin may penetrate any portion of the first sleeve 110, plug seat 160, plug seat carrier 161, or locking sleeve 170 provided that the shear pin prevents movement of the plug seat 160 and/or first sleeve 110 when intact and does not interfere with operation of the tool once it has broken. While such shear pins are present are desirable for certain embodiments of the present disclosure, use of shear pins or other devices for preventing movement of the first sleeve 110, plug seat 160, and locking sleeve 170 are not required for the apparatus and method of the present disclosure.

Plug seat 160 comprises an inlet 162 and an outlet 164. The inlet 162 generally comprises the surface of the plug seat 160 that fluids, a plug, or other materials will first encounter when travelling from a well head or from fluid pumps positioned at an end of the tubing string. The inlet 162 will also typically function as the plug seat 160 surface against which a plug traveling from the well will form a seal. It will be apparent that, in the illustrated embodiment, the illustrated shear pins 101 will generally be broken as a result of a pressure differential across the plug seat 160 where the fluid pressure is higher at the inlet 162 than at the outlet 164.

Additional features of the embodiment illustrated by FIG. 1 include opposing sets of a complimentary wicker teeth 150*a*, 150*b* wherein a first set of teeth 150*a* is associated with the locking sleeve 170 and a second set of teeth 150*b* is associated with the second sleeve 120. The sleeve's 120, 170 incorporation of complimentary set of teeth 150 is not consequential; only the ability of the sleeves to engage upon movement of either or both of the sleeves 170, 120 is required. Upon actuation of the sleeve assembly 100, typically by creating a pressure differential across the plug seat 160, the inner sleeve assembly comprising plug seat 160, first sleeve 110, and locking sleeve 170 move 115 toward second sleeve 120, opening the first housing ports 130 and, contemporaneously, causing the first set of teeth 150*a* and the second set of teeth 150*b* of the complimentary wicker teeth 150 to engage and bring the second sleeve 120 into mechanical communication with the plug seat 160. In alternate embodiments, however, the second sleeve 120 may move in coordination with the first sleeve 110 to engage the first 150*a* and second 150*b* sets of the complimentary set of teeth 150, or such first 150*a* and second 150*b* sets may become engaged through the movement of the second sleeve 120 without or apart from movement by the first sleeve 110.

As shown in FIG. 3, the locking sleeve 170 may be adjacent to, and in this embodiment, overlapping the second sleeve 120. Further, the locking sleeve 170 is in communication with the housing 105 through the locking assembly 600. In the illustrated embodiment, locking assembly 600 comprises a moveable bar 610, also referred to as a housing lock, a ball 620, and a stationary bar 630, also referred to as a sleeve lock. The ball 620 rests against an outer surface of locking sleeve 170, between sleeve lock 630 and housing lock 610. The size of ball 620 is sufficiently large that, when resting on the outer surface 172 of locking sleeve 170, the ball engages sleeve lock 630, and housing lock 610, preventing movement of housing lock 610. Because the second sleeve 120 is connected to housing lock 610, this arrangement prevents movement of the second sleeve 120. Further, the locking sleeve comprises a recessed surface 174 positioned such that actuation of the tool moves the recessed surface 174 towards the ball 620.

Figure 4A:
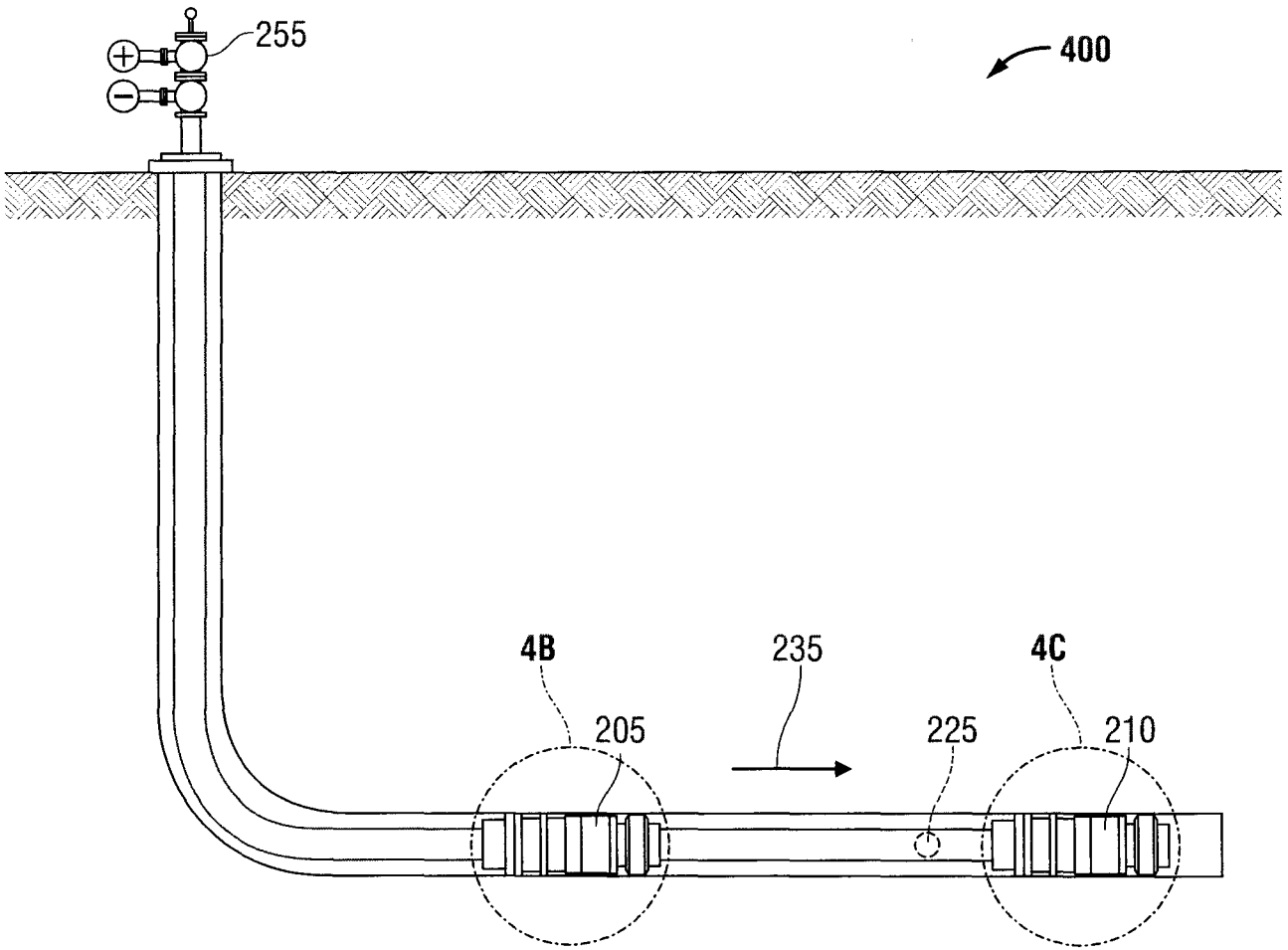
FIG. 4*a* depicts a tubing string installed in a well, showing the relative locations of a a first sleeve assembly and a second sleeve assembly.
Figure 4B:
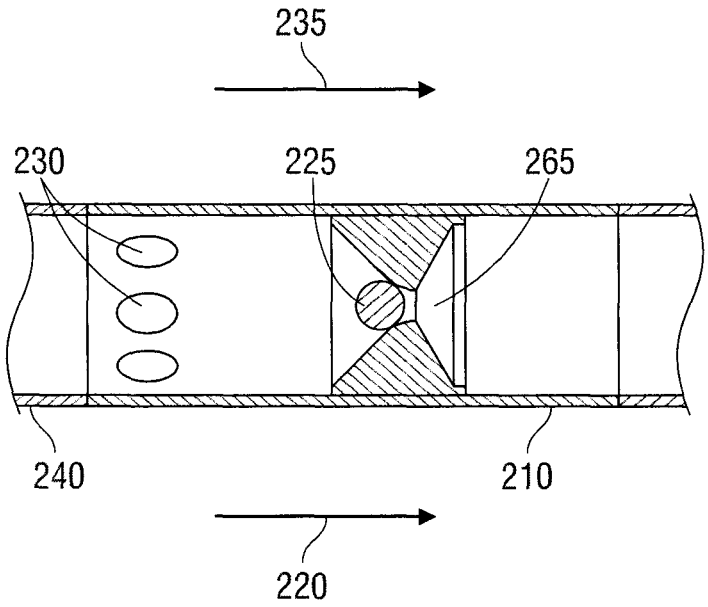
FIG. 4*b* conceptually illustrates a cross section from the first sleeve assembly of FIG. 4*a*. example embodiment of a first sleeve assembly and a second sleeve assembly, each of which have various features, including a first plug that moves through the second sleeve assembly's plug seat and is stuck on the inlet of the first sleeve assembly's plug seat in the tubing string and in accordance with this disclosure.
Figure 4C:
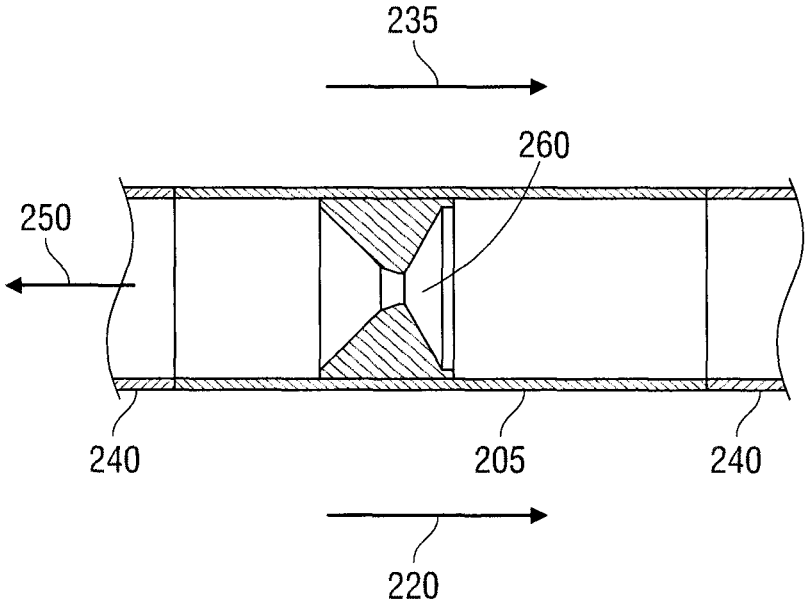
FIG. 4*c* conceptually illustrates a cross section from the second sleeve assembly if FIG. 4*a*.

With reference to FIG. 4, a first plug 225 may move 235 in the fluid flow direction 215 in a tubing string, such as, for example, in a well for water, or for oil, gas, or other hydrocarbons. The first plug 225, for instance, may have been passed, e.g., dropped, from a wellhead 255 and passed through a first sleeve assembly 205 arranged to provide a fluid flow bypass, such as the sleeve assembly of FIG. 1. The plug 225 has a larger cross sectional area than the opening of a plug seat 260 in first sleeve assembly 205 and thus plug seat 260 may be an expandable plug seat or an expandable split ring plug seat, or the plug 225 is configured to extrude through the plug seat 260 while retaining its ability to seal against later engaged plug seats. When the first plug 225 engages at the first plug seat 260, pumping into the tubing string may create a differential pressure across the plug seat 260. When the differential pressure is sufficiently high, the plug 225 is forced through the plug seat 260, creating the condition of the tubing string illustrated by FIG. 4. In some embodiments, a shear pin (101 in FIG. 1) does not break at the pressure required to extrude the plug 225 through plug seat 260. In the illustrated embodiment, the plug 225 therefore is moved between the first sleeve assembly 205 and second sleeve assembly 210, without shifting the plug seat or otherwise actuating the tool of first sleeve assembly 205. In other embodiments, a slotted sleeve or other guide element may be used to facilitate passing of the plug 225 through the plug seat, through an expandable plug seat or through an expandable c-ring plug seat without opening the first set of ports (130 FIG. 1) or without leaving the first ports open after the plug has passed.

It will be appreciated that a shear pin may be included that will break at a pressure below the pressure required for the plug to extrude and that the plug will actuate the tool prior to moving between the first sleeve assembly and second sleeve assembly. Such an arrangement is within the scope of the present disclosure.

The first plug 225 may encounter a second assembly 210, which, generally speaking, will not allow the plug 225 to pass further through the tubing string. For example, the passage through a second plug seat 265 in the second assembly 210 may be too small for extrusion of the plug 225 at the pressure differentials created across the plug 225 and second plug seat 265. The second assembly 210 may be a second sleeve assembly, a plug and plug seat actuated flapper valve, any other plug and plug seat actuated tool, a blind plug seat with no associated tool, or any other device for stopping travel of the plug 225 through the tubing string.

Figure 5A:
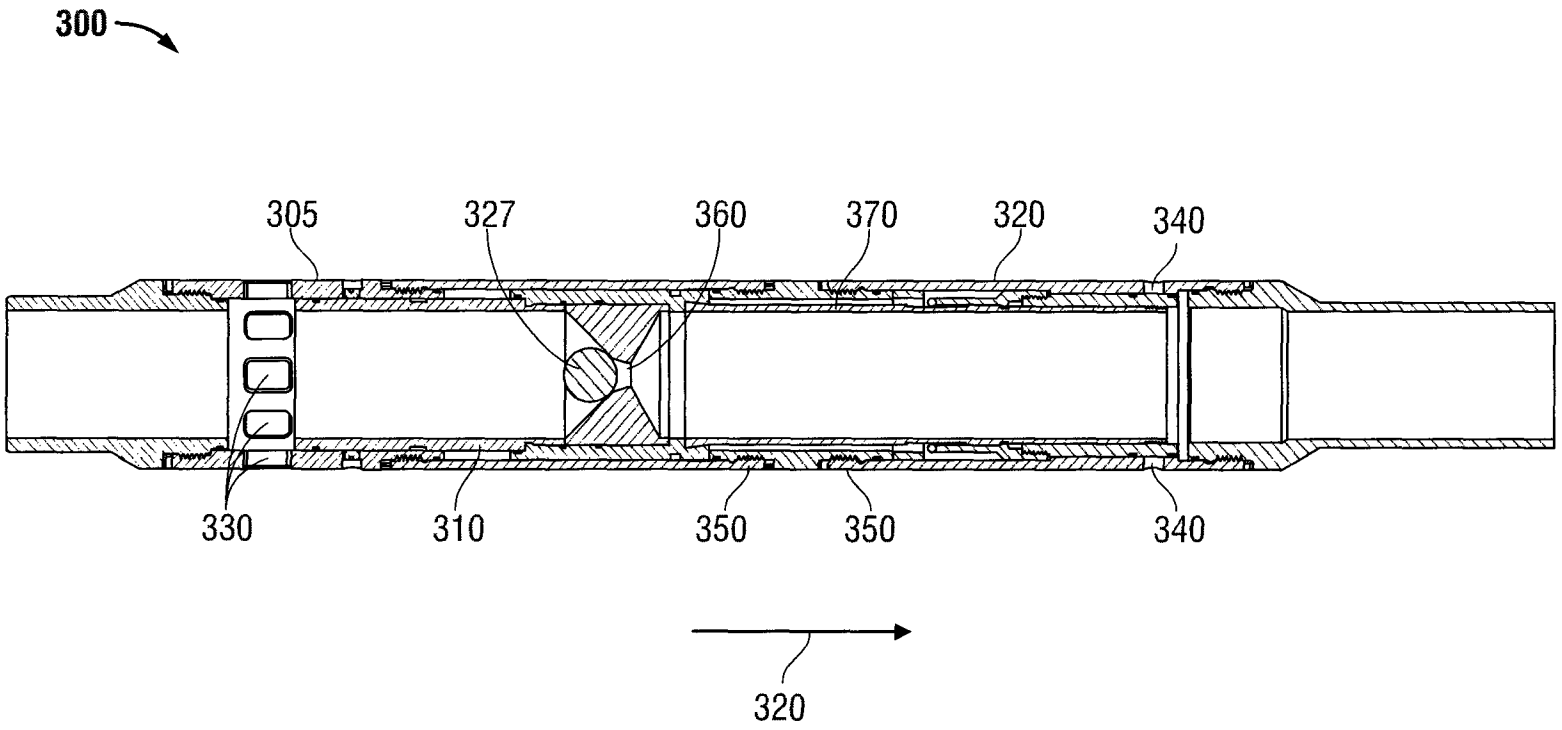
FIG. 5*a* depicts a flowback bypass device after the plug seat and first sleeve have been shifted by a differential pressure created across the plug seat.
Figure 5B:
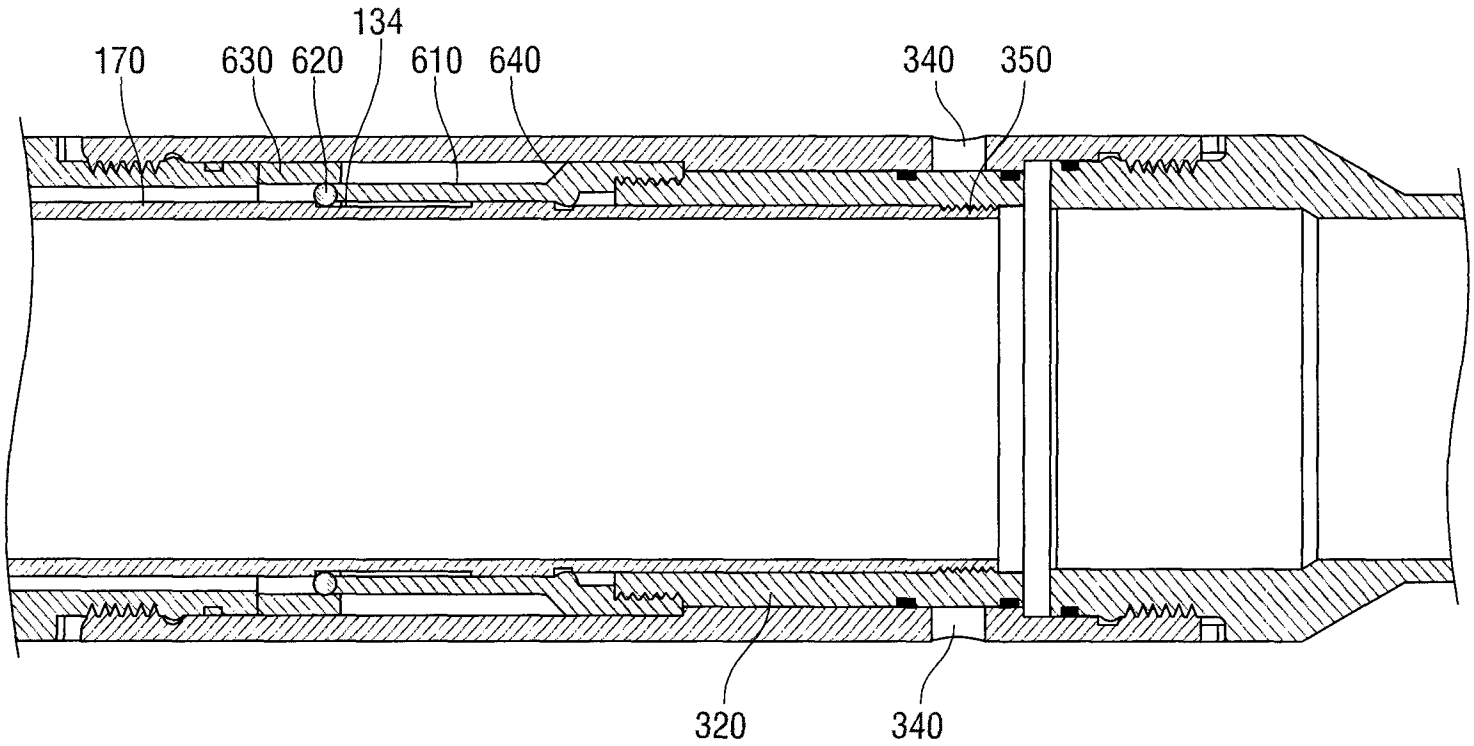
FIG. 5*b* depicts an enlargement of a portion of the flowback device from FIG. 5*a* to further highlight certain aspects of the device.

FIGS. 5*a* and 5*b* depict the illustrative embodiment of FIG. 1 engaged with a second plug 327. FIG. 5*b* is an enlargement of FIG. 5*a* in the region containing and adjacent to the second sleeve 320 of FIG. 5*a*. In this embodiment, the second plug 327 seals against the plug seat 360 to facilitate creation of a pressure differential sufficient to break the shear pins 301. The second plug 327 may be larger than the first plug (225 FIG. 2) or may be made of a different material. For example, and by way of illustration, not limitation, the at least one shear pin 301 may be configured to break at a desired pressure differential across the plug seat 360. Any desired pressure differential may be chosen provided only that such pressure differential may not be so high that the pressure differential is difficult to impossible to reach without extruding or breaking the available plugs and may not be so low that the at least one shear pin will break at a pressure differential below which any of the selected plugs will extrude. The at least one shear pin 301 of the present disclosure is preferably selected to break at pressures between 400 and 1800 psi and more preferably selected to break between 800 and 1400 psi. A first plug that extrudes through plug seat 360 at a pressure of below 1400 psi, such as 800 to 1100 psi, may be selected, thereby allowing the first plug to pass plug seat 360 without breaking the at least one shear pin 301.

A second plug may then engage the plug seat 360. The second plug may be selected such that it will not extrude through plug seat 360 until the pressure differential across the plug seat 360 exceeds the pressure required to break the at least one shear pin 301. Therefore, rather than extrude the second plug through the plug seat 360, the at least one shear pin 301 is broken allowing the plug seat 360 as well as the attached first sleeve 310 and the locking section 370 to move in the downward direction. This movement of plug seat 360 and first sleeve 310 opens the first set of ports 330 thereby creating fluid communication between the passageway through the assembly and the exterior of the assembly and facilitating treatment of the adjacent formation. The second sleeve 320 remains closed in this embodiment so that fluid may not flow around the ball seat and back into the tubing string rather than into the adjacent formation or other areas to be treated. The first plug 225 and second plug 327 of the illustrative embodiment may each be selected based on their respective sizes relative to the plug seats, the material or materials from which a selected plug is manufactured, combinations of the above, or any other factor provided that the selected plug performs the desired function of sealing against the plug seat 360 and either extruding through the plug seat 360 at a pressure differential insufficient to break the at least one shear pin 301 or maintaining its seal with plug seat 360 up to at least a pressure differential sufficient to break the at least one shear pin 301.

When locking sleeve 370 shifts, the recessed surface 374 is brought adjacent to the ball 620 of locking mechanism 600, such that ball 620 now has sufficient clearance to fit between recessed surface 374 and the stationary bar 630, unlocking the locking mechanism. Further, the locking sleeve 370 and second sleeve 320 are now interlocked through adjoining their complimentary portions of wicker teeth 350, connecting these two sleeves. It will be apparent that any adjoining method or system is acceptable and is not limited to teeth as described herein. For example, the sleeves 310, 320 may permanently or temporarily interlock by use of retaining rings, locking rings, gears, or any other method of joining the ends upon movement of the locking sleeve 370 relative to the second sleeve 320.

Figure 6:
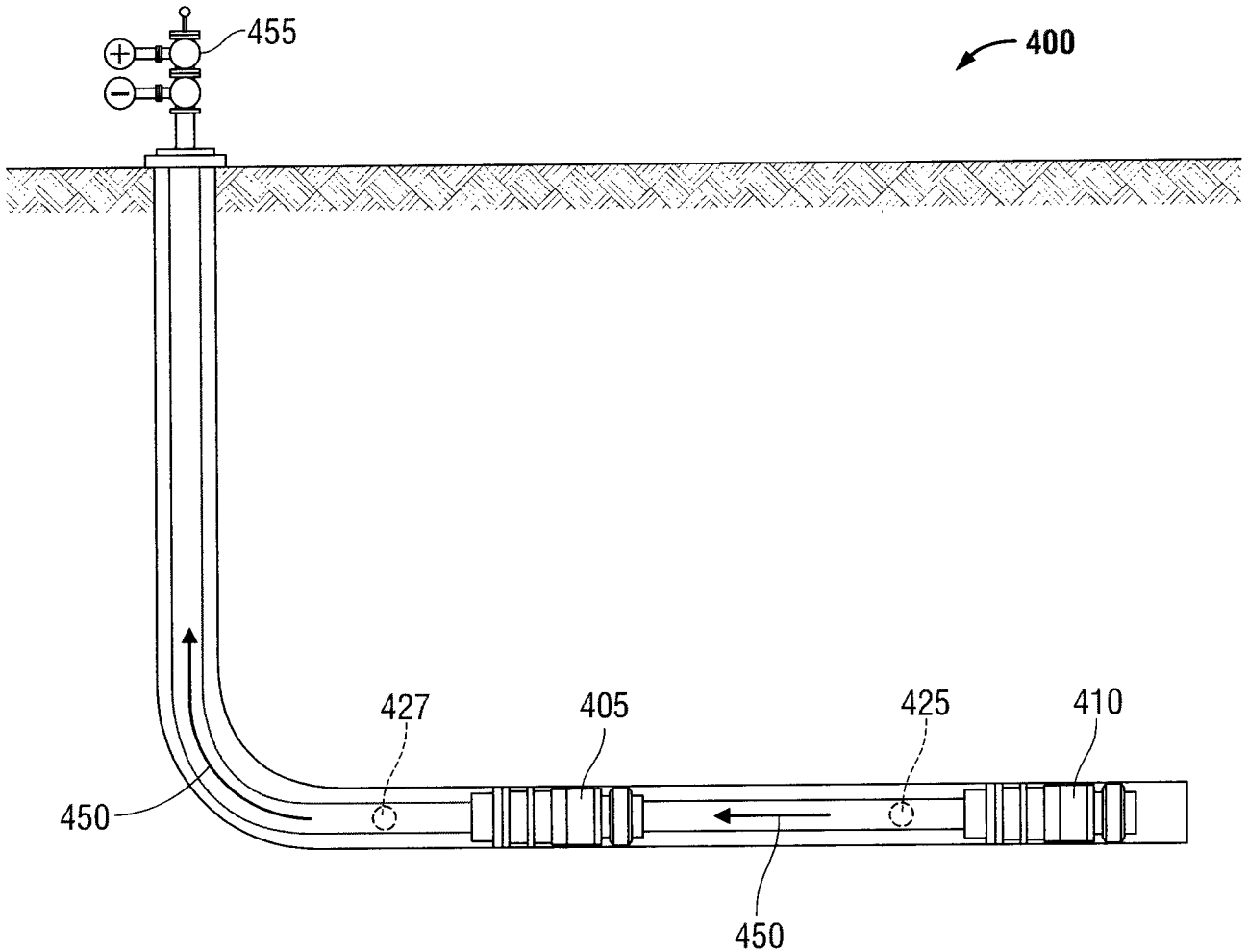
FIG. 6 depicts a tubing string installed in a well, showing the relative locations of a first sleeve assembly and a second sleeve assembly, the locations of plugs used to seal against the plug seats of the sleeve assemblies and direction of fluid flow effecting the movement of the plugs within the tubing string.

Moving on to FIG. 6, the first plug 425 and the second plug 427 are in motion as a result of fluids flowing 450 from the well toward the wellhead 455, i.e. the fluid flow is reversed, or the well is flowed back or produced after treatment is finished. Here, the plugs 425, 427 are no longer engaged with the plug seats in the second assembly 410 and first assembly 405 respectively, because reversal of the fluid flow occurred, for example, by opening a valve at the wellhead to alleviate pressure and/or collect fracing and production fluids. It will be appreciated that the direction of fluid flowing 450 towards the well head will case the first ball 425 to engage the first assembly 405 on the outlet (FIG. 2 164) of the plug seat (FIG. 2 160).

Figure 7:
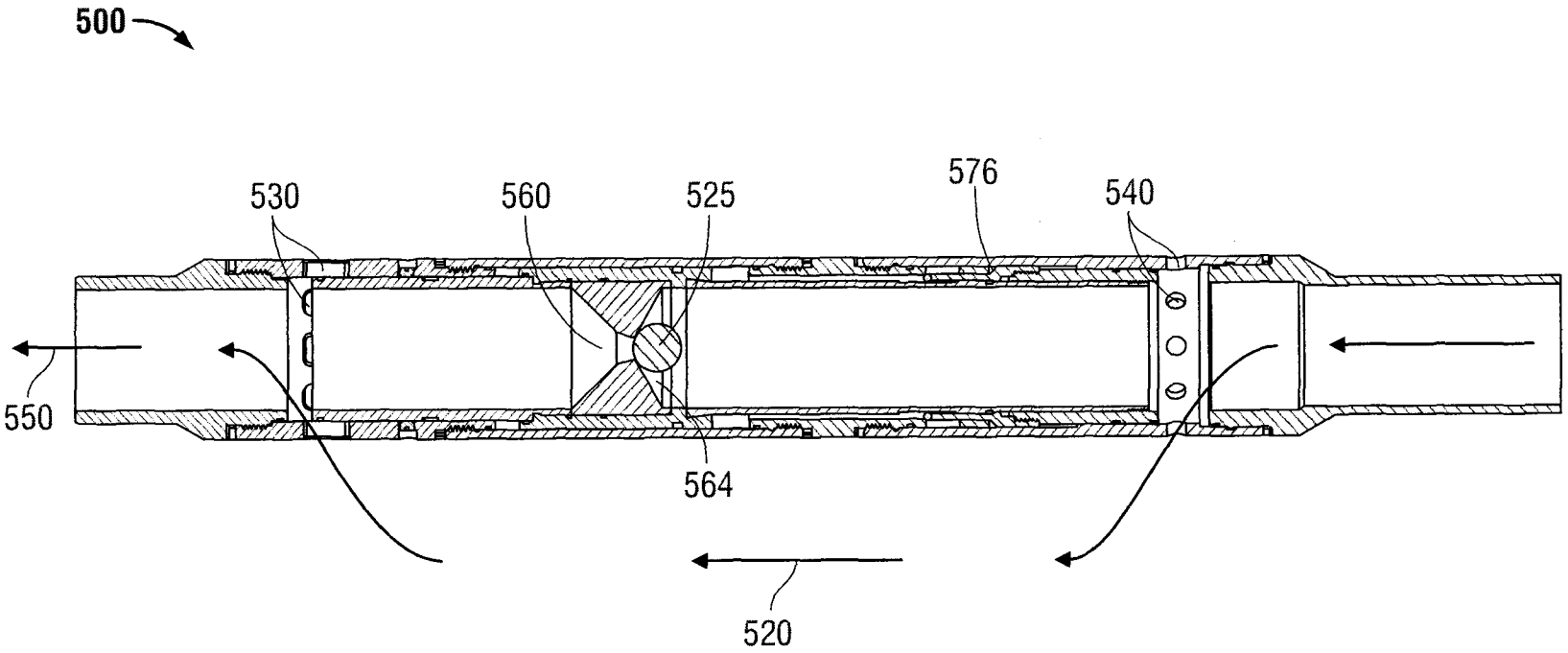
FIG. 7 depicts a flowback bypass device with a plug engaged on the outlet or downhole side of the plug seat. The second set of ports are open due to the pressure differential caused by such engagement and fluid is bypassing the plug set by exiting the device through the second set of ports and re-entering the device through the first set of ports.

Finally, with reference with FIG. 7, subsequent to reversing the fluid flow, the first plug 525, formerly engaged on the plug seat (265 FIG. 4) of second assembly (210 FIG. 2, 410 FIG. 6), moves upstream and engages on the downhole, or outlet, side of the plug seat 560 located in the first sleeve assembly (405 FIG. 6). The first plug's 525 new engagement blocks the flow of fluid through the tubing string to the wellhead. However, blocking the flow of reservoir fluids causes a pressure differential across the plug seat 560, thereby exerting force on the second inner sleeve assembly and the now connected second sleeve. This pressure causes the inner sleeve assembly and second sleeve to shift, opening a second set of ports 540. The travel of the combined first sleeve 510, plug seat 560, locking sleeve 570, and second sleeve is limited by engagement of a shoulder 576 of the moveable bar 610 with the stationary bar 630 so that the first set of ports 530 are not closed, or are not closed entirely by movement of the first sleeve 510. As a result, the fluid flow 520 bypasses the blockage occurring at the first plug 525 engaged on the outlet 564 of plug seat 560. Instead, the fluid flows according to the path partially defined by the second set of ports 540, the annulus between an exterior of the second sleeve assembly 500 and the geologic formation into which the tubing string is installed, and the first set of ports 530 first sleeve assembly 500. It will be appreciated that the path for fluid flow defined by the annulus, first set of ports 530, and second set of ports 540 avoids and otherwise circumvents the blockage caused by engagement of the plug 525 on the outlet 564 of plug seat 560. Once the fluid reenters the tubing string at first set of ports 530, it then may continue flowing through the tubing string toward the wellhead.

The embodiment locking mechanism illustrated in the figures is shown such that the moveable bar moves parallel to the longitudinal axis of the tubing string upon release of the lock. However, the locking bar, moveable bar, bolt, and stationary bar may also be arranged to prevent rotational movement around a circumference or perimeter of the tubing string. Further, the direction in which the locking bar moves does not necessarily dictate the direction of movement the locking bar prevents, e.g., a locking bar may hold a tab in place to prevent rotation movement of the locked piece.

Further, it will be appreciated that the ball 620 acts as a bolt, cam, or similar restrictor element of a lock to create communication between the generally moveable sleeve lock 630 and the generally stationary housing lock 610, thereby immobilizing the sleeve lock 630. Other bolts or cams, including dogs, collets, pins, bars, or other structure, may be substituted for the ball 620 provided that such structure engages or otherwise causes mechanical communication between a stationary element and a moveable element, and is removeable from such engagement or communication upon movement of the support structure or support element.

Additionally, the illustrated embodiments show the obstruction in the passageway is bypassed by flowing fluids along the exterior of the tubing, but other arrangements are within the scope of the present disclosure. For example, the bypass around the obstruction in the passageway may be contained within the housing, between a valve seat and the housing, or other arrangement that provides fluid communication around the obstruction.

The embodiments of the present disclosure may be used in both open hole and cemented tubing strings. In cemented tubing applications, the well treatments may be used to mechanically break, dissolve, or otherwise create a flow path through the cement connecting the first and second at least one ports along the outside of the assembly. In other embodiments, the first and second at least one port may be connected.

While the foregoing is directed to example embodiments of the present disclosure, other and further embodiments of the invention may be devised without departing from the basic scope thereof, and the scope thereof is determined by the claims that follow.

What is claimed is:

1. An apparatus for use in a well for oil, gas, or other hydrocarbons, the apparatus comprising:

a housing with an exterior and an interior, the housing having a passageway therethrough, a first port, and a second port, the first port and second port capable of the connecting the passageway with the exterior of the housing;

a plug seat within the housing, the plug seat having an inlet and an outlet;

a bypass sleeve within the housing, the bypass sleeve positioned to prevent fluid communication between the passageway and the exterior of the housing through the second port;

wherein, the bypass sleeve is moveable within the housing in response to a pressure differential across the plug seat, the pressure differential comprising a higher pressure at the outlet than at the inlet.

2. The apparatus of claim 1 further comprising a treatment sleeve slidably mounted within the housing, the treatment sleeve positioned to prevent fluid communication between the passageway and the exterior of housing through the first port.

3. The apparatus of claim 1 further comprising a treatment sleeve slidably mounted within the housing in communication with the plug seat, the treatment sleeve positioned to prevent fluid communication between the passageway and the exterior of housing through the first port.

4. The apparatus of claim 3 further comprising the treatment sleeve having a first position and a second position, wherein the treatment sleeve is movable from the first position to the second position in response to a pressure differential across the plug seat, the pressure differential comprising a higher pressure at the inlet than at the outlet.

5. The apparatus of claim 1 further comprising a treatment sleeve slidably mounted within the housing, the treatment sleeve having a first position between the passageway and the first port and a second position, and a sequencing element preventing movement of the bypass sleeve until the treatment sleeve moves to the second position.

6. The apparatus of claim 5 wherein the sequencing element comprises a locking assembly.

7. The apparatus of claim 1 further comprising a locking assembly preventing movement of the bypass sleeve, said locking assembly comprising:

a restrictor element; and a recessed surface;

wherein, the recessed surface is moveable in response to movement of a treating sleeve from a first treating sleeve position to a second treating sleeve position and the lock assembly permits movement of the bypass sleeve when the treating sleeve moves to the second treating sleeve position.

8. The apparatus of claim 7 further wherein the locking assembly permits movement of the bypass sleeve when the recessed surface engages the restrictor element.

9. An apparatus for use in a well for oil, gas, or other hydrocarbons, the apparatus comprising:

a housing with an exterior and an interior, the housing having a first passageway therethrough, and at least partially defining a bypass flowpath;

a first port and a second port downwell of the first port, the first port and the second port each capable of connecting the passageway and a passageway bypass;

an obstruction in the interior of the housing, the obstruction positioned between the first port and the second port;

a barrier positioned to prevent fluid communication between the passageway and the passageway bypass through the second port;

wherein, the barrier is removable in response to a pressure differential across the obstruction, the pressure differential comprising a higher pressure on the side of the obstruction adjacent to the second port in comparison with the pressure on the side of the obstruction adjacent to the first port.

10. The apparatus of claim 9, the passageway bypass further defined, in part, by the well.

11. The apparatus of claim 9, the passageway bypass further defined by tubing in the well.

12. The apparatus of claim 9, the housing further comprising a passageway bypass member in fluid communication between the first port and the second port.

13. The apparatus of claim 9, the obstruction comprising a plug seat.

14. A method for facilitating bi-directional fluid flow in a well, the method comprising flowing fluid through a valve assembly in the well, the valve assembly comprising a housing with an exterior and an interior, the housing having a passageway therethrough, a first port, and a second port, the first port and second port capable of the connecting the passageway with the exterior of the housing;

an obstruction within the housing, the obstruction between the first port and the second port;

a bypass sleeve within the housing, the bypass sleeve having a first position preventing fluid communication between the passageway and the exterior through the second port and second position permitting fluid communication between the passageway and the exterior through the second port;

pumping fluids through the tubing string and out of the first at least one port;

facilitating the formation of a flowback pressure differential across the obstruction with a first pressure adjacent to the first port that is lower than a second pressure adjacent to the second port; and moving the bypass sleeve from the first position to the second position to permit fluid communication between the first port and the second port around the obstruction.

15. The method of claim 14, further comprising creating a first pressure differential, across the plug seat before creating the flowback pressure differential, the first pressure differential comprising a first pressure adjacent to the first port that is higher than a second pressure adjacent to the second port.

16. The method of claim 14, wherein the valve assembly comprises a plug seat having an inlet and an outlet, the method further comprising creating a first pressure differential across the plug seat to initiate fluid communication between the passageway and the exterior of the housing before creating the flowback pressure differential, the first pressure differential comprising a higher pressure at the inlet than at the outlet.

17. The method of claim 16 wherein the pumping step comprises a fracturing treatment.

18. The method of claim 17, the valve assembly further comprising at least one shear pin in mechanical communication with the at least one plug seat, the method further comprising engaging a first plug on the inlet side of the plug seat;

creating a extrusion pressure differential across the plug seat and causing the first plug to pass through the first plug seat; and engaging a second plug on the inlet side of the plug seat;

wherein engagement of the second plug on the inlet side of the plug seat facilitates formation of the first pressure differential and the first pressure differential applies sufficient force to break the shear pin.

19. The method of claim 16 wherein the engagement of the first plug on the outlet side of the plug seat facilitates formation of the flowback pressure differential.

* * * * *